United States Patent [19]

Stull

[11] Patent Number: 4,477,002

[45] Date of Patent: Oct. 16, 1984

[54] DISPENSING CAP CONSTRUCTION

[76] Inventor: Gene Stull, 5 Oak St., Chester, N.J. 07930

[21] Appl. No.: 404,768

[22] Filed: Aug. 3, 1982

[51] Int. Cl.[3] ..... B67D 5/06

[52] U.S. Cl. ..... 222/521; 222/520; 222/549

[58] Field of Search ..... 222/519, 520, 521, 548, 222/549, 552, 544

[56] References Cited

U.S. PATENT DOCUMENTS

| | | | |
|---|---|---|---|
| 3,033,428 | 5/1962 | Van Baarn | 222/549 |
| 3,369,707 | 2/1968 | Porter et al. | 222/521 |
| 3,407,967 | 10/1968 | Stull | 222/48 |

*Primary Examiner*—Joseph J. Rolla
*Assistant Examiner*—George Pyryt
*Attorney, Agent, or Firm*—H. Gibner Lehmann; K. Gibner Lehmann

[57] ABSTRACT

A cam-advance, thread-retract dispensing stopper cap construction of unusually short axial dimension, comprising a body portion having annular walls with a discharge passage extending through it, and a captive screw cap movable axially on the body portion between sealing and dispensing positions. Both the screw cap and the body portion have cooperable screw threads which are operable in a screwing-down direction only. The body portion has a stopper plug which is carried in the discharge passage by means of multiple webs, and which is adapted to be received in a discharge orifice of the screw cap when the latter is disposed in the sealing or fully screwed-down position. An annular space is defined between the walls of the body portion and the stopper plug, and contains a curved cam track on which a depending cam follower lug of the screw cap can ride as the latter is unscrewed, thereby to positively force the cap open. The arrangement is such that in the fully unscrewed condition, the discharge orifice of the screw cap is raised above the stopper plug a sufficient amount to permit the contents of the container to be dispensed therethrough. Due to the unique arrangement of the cooperable threads and of the cam track and follower construction, an extremely compact closure is realizeable, with only a minimum amount of axial length being required. This is important in certain applications, as where it is necessary to limit the overall axial length of the container.

15 Claims, 7 Drawing Figures

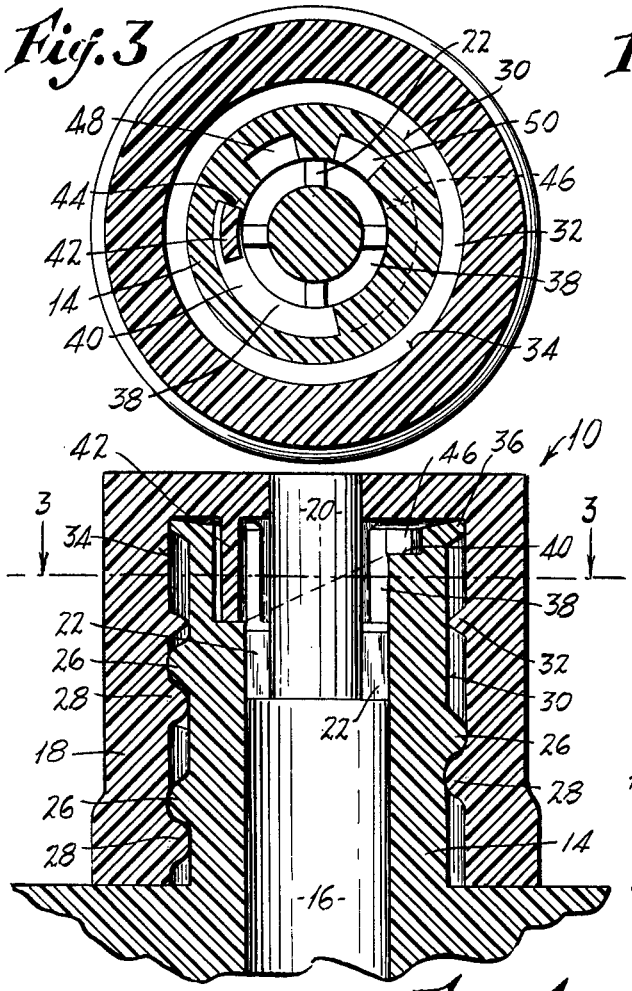
Fig. 3
Fig. 1
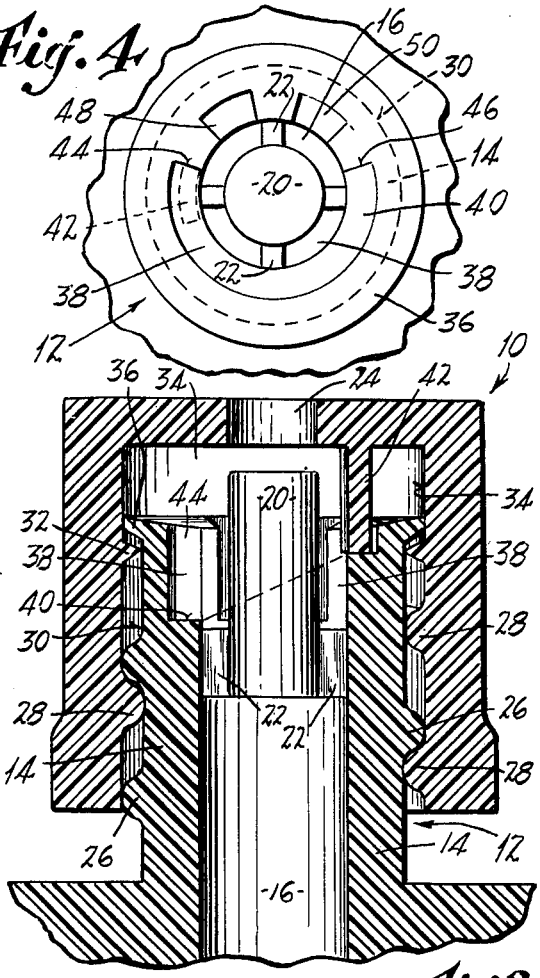
Fig. 4
Fig. 2
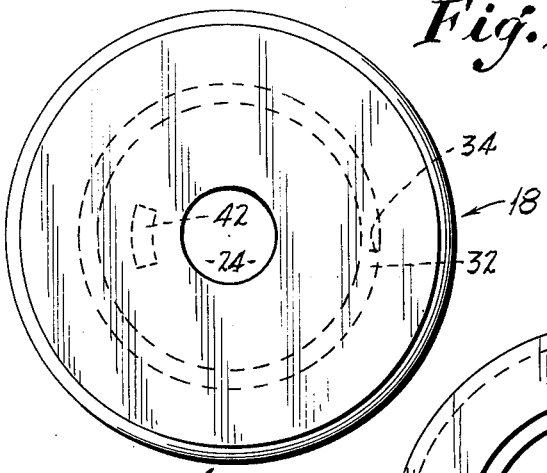
Fig. 6
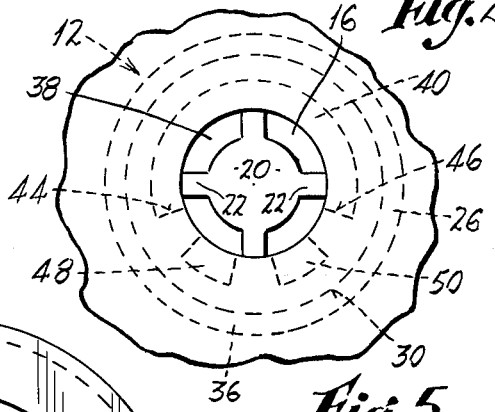
Fig. 5
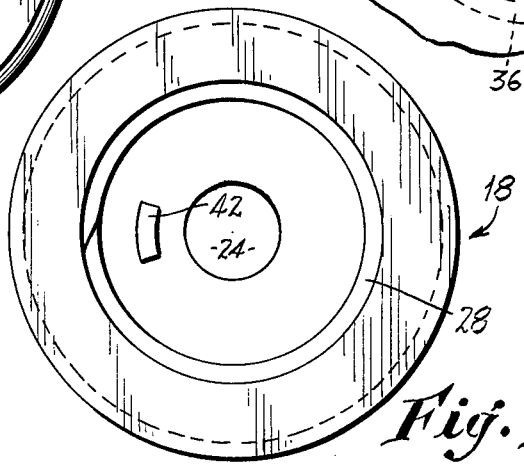
Fig. 7

DISPENSING CAP CONSTRUCTION

This invention relates generally to turnable closures for various types of dispensing containers, and more particularly to closures of the type that incorporate cooperable screw threads on a neck portion of a bottle and on a screw cap, in order to effect the opening or closing of the dispenser.

In the past, a number of different types of dispensing closures have been proposed and produced, and have met with varying degrees of success or acceptance. U.S. Pat. No. 3,370,764 shows one type of dispenser incorporating a screw cap having a discharge orifice, and a cap body portion having an upstanding plug which is receivable in the discharge orifice in order to effect the sealing thereof. In this patented construction, the advancing and retracting movement of the screw cap is accomplished primarily by the cooperable screw threads on the body and the cap. In order to avoid problems with solidified product causing fouling of the threads, a positive-type supplementary advance mechanism was provided in the form of a cam track on the screw cap body, and a follower shoulder on the screw cap. Under such circumstances, in the event that hardened product such as glue occupied the area around the stopper plug and discharge orifice, the positive advance provided by the cam and cam follower would insure that the screw cap would open under the application of suitable force to the latter in an unscrewing direction. Accordingly, any tendency for the threads to strip past one another was minimized, and improved operation of the dispenser was thus realizeable.

In the above patent, multi-turn threads were employed in order to provide the degree of axial movement that was desired, and also in order to reduce any possibility of the threads inadvertently "stripping" past one another in the case of product becoming hardened inside the screw cap. These threads were intended to operate and be effective in two directions, even in the presence of the cam and cam follower structure, one direction being a screwing down of the cap, and the other being an unscrewing of the same.

Other constructions involving both threaded drives and cam/cam follower type drives for the screw caps are illustrated in U.S. Pat. Nos. 3,598,285; 3,406,880 and 3,407,967. In the latter three patents, the cam tracks that were employed were disposed at a location on the body portion that was below that of the threads, and wherein one or more lugs carried on the inner surface of the screw cap would engage the cam track and ride up the same as the cap was unscrewed from a fully-on position.

Still other cap constructions are illustrated in U.S. Pat. Nos. 3,216,630; 3,351,249 and 3,319,843.

While all of the dispensers described or mentioned above operated in a satisfactory manner, as is the case with most commercial products, there existed room for improvement, as by making changes which resulted in less expensive production, easier operation, simplified assembly, and other modifications which enabled the devices to to physically smaller or aesthetically more pleasing.

SUMMARY

Some of the disadvantages of prior dispensing devices of the captive screw cap type are obviated by the present invention, which has for one object the provision of a novel and improved dispensing cap construction which is extemely simple in its structure while at the same time being especially short in its axial dimension, all without sacrificing either utility or ease of operation.

A related object of the invention is to provide an improved cap construction as above set forth, wherein the parts making up the cap can be readily molded in simple plastic molds, thus keeping the manufacturing and assembly costs to an absolute minimum.

Yet another object of the invention is to provide an improved cap construction as characterized, which is especially easy to use, thus making it attractive to the consumer and enhancing the marketability of the device.

Still another object of the invention is to provide an improved cap construction of the kind indicated, wherein the screw cap can be opened by turning through essentially one-half of a revolution, and thereafter re-sealed by a similar operation.

Yet another object of the invention is to provide an improved cap construction as outlined above, wherein a highly effective seal is incorporated in the cap, without interference from either the screw threads on the parts, or the cam/cam follower structures, thus insuring a high degree of reliability, and freedom from inadvertent leakage or spillage.

A still further object of the invention is to provide a novel cap construction which is aesthetically pleasing, thus making it especially attractive and appealing to the prospective purchaser.

The above objects are accomplished by the provision of a cam-advance, thread-retract dispensing stopper cap construction of unusually short axial dimension, comprising in combination an elongate tubular body portion having annular walls, and having a discharge passage extending through it, and a screw cap carried by the tubular body portion and having internal screw threads for engagement with cooperable external screw threads on the body portion. The body portion has a stopper plug in the discharge passage, which projects from the discharge end and is supported therein by suitable support means. The body portion further has an annular space at its discharge end, between its annular walls and the stopper plug, and an annular exterior sealing surface located above the screw threads and disposed radially outward of and surrounding the annular space. The screw cap has an annular sealing bead engaging and movable along the sealing surface when the screw cap moves axially on the body portion. Also on the body portion is an internal curved cam track which is located in the designated annular space. The screw cap has a cam follower lug which extends into the said annular space and rides up the curved cam track thereof. At the top wall of the screw cap is a discharge orifice which is closed by the stopper plug when the cap is screwed down on the body portion under the action of the screw threads. The unscrewing movement of the cap causes it to be forcibly raised axially on the body portion to open the orifice, under the action of the follower lug riding on the cam track. The arrangement is such that by the provision of the cam lug and cam track at the particular location specified above, an especially short axial length for the cap can be realized, without sacrificing ease of operability and without jeopardizing the excellent sealing characteristics. The appearance of the cap is greatly enhanced by its small physical size, and it is felt that this attribute contributes greatly to the appeal of the dispenser.

Other features and advantages will hereinafter appear.

In the drawings, illustrating a preferred embodiment of the invention.

FIG. 1 is a vertical section of the improved cam-advance, thread-retract cap construction of the present invention, shown in the closed, fully screwed on position.

FIG. 2 is a view like FIG. 1, except showing the screw cap as having been unscrewed by a fraction of a turn, this constituting the open or unscrewed position.

FIG. 3 is a section taken on the line 3—3 of FIG. 1.

FIG. 4 is a top plan view of the body portion of the dispensing cap construction of FIG. 1.

FIG. 5 is a fragmentary bottom plan view of the body portion of the cap construction.

FIG. 6 is a top plan view of the screw cap part of the dispenser, and

FIG. 7 is a bottom plan view of the screw cap part.

Referring to FIGS. 1 and 2 and in accordance with the present invention there is illustrated a novel and improved cam-advance, thread-retract stopper cap construction for a dispenser, generally designated by the numeral 10, comprising an elongate tubular body portion 12 having annular walls 14 and a discharge passage or bore 16. The body portion 12 can be in the form of the neck of a plastic bottle, in which case it would be integral with the remainder of the container, or alternately can be a part of a cap assembly or fitment that would snap into or be threaded onto an existing container or bottle. Cooperable with the body portion is a screw cap generally designated 18, which can shift axially with respect to the body portion 12, between an open or dispensing position shown in FIG. 2, and a closed or sealing position illustrated in FIG. 1. The closed position is hereafter referred to as the screwed down position of the screw cap 18.

The body portion 12 has a stopper plug 20 which is preferably of cylindrical configuration, being supported in the bore 16 by a web structure in the form of a series of integral short webs 22, as shown in FIGS. 3 and 4. There are spaces between the webs 22 such that the fluid contents of the dispenser can flow around the plug 20 and out through a discharge opening 24 of the screw cap 18. Disposed on the neck of the body portion 12 is an external thread 26 which is cooperable with an internal thread 28 on the inner surface of the screw cap 18. According to the present invention, the threads 26 and 28 operate to pull the screw cap 18 axially inward only, with the advancing movement of the screw cap being accomplished by a positive-action cam and cam follower arrangement to be described below.

Referring again to FIGS. 1 and 2, the body portion 12 has an annular exterior sealing surface 30 which is located above the threads 26, and is normally engaged by an annular internal sealing bead 32 disposed on the inner surface of the screw cap 18. Also, the area above the bead 32 on the screw cap 18 constitutes an annular internal sealing surface, indicated at 34, which is slidably engaged by an annular external sealing bead 36 at the upper part of the body portion 12.

In accordance with the present invention, there is provided an annular space between the annular walls 14 of the body portion 12 and the stopper plug 20, the space being designated by the numeral 38; disposed in this space is an internal curved cam track 40 which is of generally helical configuration, and which is adapted to be engaged by a depending cam follower lug 42, having a lower end or extremity which slidably engages the surface of the cam track 40 as the screw cap 18 is turned. The cam track is shown as being roughly 180 degrees in circumferential extent, but other ranges could be employed as well, with equally good results. For example, a curved cam track extending through an arc of just under 360 degrees could alternately be arranged.

As provided by the invention, the sealing surface 30 is disposed radially outward of and surrounds the annular space 38. Also, the web structure 22 is disposed in this space. As shown, the cam follower lug 42 is integral with the top wall of the screw cap 18, and extends downwardly therefrom and into the annular space 38. Its length is on the order of one-quarter to one-third the overall height of the screw cap. This figure is given by way of example only, as other specific lug configurations could be employed with equally good results.

At the lower part of the cam track 40, there exists a stop or stop shoulder 44 which limits the turning movement of the screw cap 18 in the clockwise direction, and an additional stop or stop shoulder 46 is provided at the upper end of the track 40 to limit the turning movement of the cap in the counterclockwise direction. The annular wall 14 can be advantageously cored out at 48 and 50, in order to save on material and reduce curing time for the plastic. Also, the tendency for the plastic to deform in this area will be minimized as a result of the reduced thickness of the wall. These cored-out spaces are circumferentially spaced from the location of the cam track 40, and are longer in an axial direction than they are wide in a circumferential direction. They are coextensive with one another and with the stopper plug 20. Also, they are disposed transversely with respect to the cam track 40.

It will be understood that the sealing or closed position of the screw cap 18 is shown in FIG. 1, whereas the open or dispensing position is shown in FIG. 2. From the position of FIG. 1, as the screw cap 18 is unscrewed the cam follower lug 42 rides up the cam track 40 until the lug 42 engages the stop shoulder 46. The screw cap 18 moves positively in an axially outward direction under solely the action of the cam lug 42 and track 40. The threads 26 and 28 can be in engagement during this time, and have a thread pitch roughly the same as that of the track 40. However, corresponding portions of the thread 28 of the screw cap are below those of the body portion 12, so that these threads cannot operate to move the screw cap axially outwardly, but merely permit such outward axial movement to occur as a result of the cam follower lug 42 riding up the cam track 40. Because of the above unique configuration and the fact that the threads are not being relied upon to move the cap outwardly, a significantly shorter path of threads can be utilized, thus making it possible to reduce the overall axial dimension of the screw cap and the body portion to an absolute minimum. This feature is of considerable importance where it is desired to minimize the overall length of the dispensing container in order to save space during storage or shipping, as well as being significant from the aesthetic standpoint. A relatively short axial length for a closure construction such as this has been found to be especially pleasing to the eye, thus adding to the total appeal of the dispenser, and enhancing its appearance.

The cooperable threads 26, 28 have considerable clearance as shown in FIGS. 1 and 2, thereby to enable a one-way screw down drive of the cap to be effected by the threads and to enable a one-way lift up drive to be effected by the cam, the latter when the cap is unscrewed during which time the axial clearance between the threads comes into play so that for this condition the threads are inactivated.

With the screw cap 18 disposed in the position of FIG. 2, fluid from the interior of the dispenser can flow past the webs 22 and stopper plug 20, and out through the discharge orifice 24 of the cap. The possibility of leakage occuring is minimized by the double seals provided by the bead 36 and surface 34, and bead 32 and surface 30. Thus, no liquid can find its way into the area around the threads 26, 28, and problems with hardened product causing fouling of the threads is virtually eliminated.

With the cam follower lug 42 and cam track 40, there exists a pronounced wiping action by the lug, which reduces any tendency for there to occur build up of product on the track.

From the position of FIG. 2, as the screw cap is turned clockwise the threads 26, 28 are already in engagement, and are effective in a direction to pull the screw cap in an axially downward direction until the lug 42 engages the stop shoulder 44. Under this circumstance, the orifice 24 will be closed off by the stopper plug 20, preventing any further dispensing.

The parts 12 and 18 can be constituted of molded plastic substance which, when cured, is resilient so as to enable the beads 32 and 36 to be forced past one another when the part 18 is assembled to the part 12. Also, the threads 26 and 28 are intended to momentarily "strip" past one another during such assembly.

The present construction has a number of other advantages. The location of the cam follower lug 42 and cam track 40 is such that (1) both parts are always completely concealed from view, thus making the device more attractive and appealing; and (2) the follower lug 42 and cam track 40 do not interfere with or detract from the sealing functions provided by the beads 32 and 36. Thus, in the present arrangement there is retained the feature of a highly reliable seal, together with the advantage of a cam-type positive advancing movement. Many of the prior art devices did not enjoy these advantages. Also, with the construction that is disclosed, only a very short axial length is required in order to provide the necessary structures to advance and retract the screw cap. This latter feature has not been characteristic of many of the prior dispensers or products that are currently in use.

The end portion of the stopper plug 20 can be formed so as to be cylindrical at its outer end, and to provide a smooth surface with, and lie in the same plane as the remainder of the upper surface of the screw cap 18. This feature also adds to the desired compact appearance.

From the above it can be seen that I have provided a novel and improved dispensing cap construction of short axial length, which is relatively simple and which is unusually compact in its physical size, this being important in keeping with current trends toward the production of aesthetically pleasing dispensers for use by the consumer. The parts can be individually molded in simple cavities and thereafter assembled to one another by automatic capping equipment, if desired, so as to keep the overall cost as low as possible.

The device is thus seen to represent a distinct advance and improvement in the technology of dispensing closures.

Variations and modifications are possible without departing from the spirit of the claims.

Each and every one of the appended claims defines a distinct aspect of the invention, separate from all others, and accordingly each claim is to be treated in this manner when examiner in light of the prior art, in any determination of novelty or validity.

What is claimed is:

1. A compact cam-advance, thread-retract dispensing stopper cap construction of short axial dimension, comprising in combination:

(a) an elongate tubular body portion having exterior and interior annular walls, and having a discharge passage extending through it, (b) said body portion having a stopper plug disposed in said passage and projecting from its discharge end, (c) support means extending between the interior annular walls of said body portion and the stopper plug, to mount the latter, (d) said body portion having an annular space in its interior annular wall at its discharge end, said space being disposed between its interior annular wall and the stopper plug, and having external screw threads on its exterior annular wall, (e) a screw cap having a top wall, said screw cap being carried by the tubular body portion and having internal screw threads for engagement with the external screw threads of said body portion, and having an annular interior sealing surface located adjacent said top wall above said screw threads and disposed radially outward of and surrounding said body portion, (f) said body portion having an annular sealing bead adjacent the discharge end, above its exterior screw threads and slidably engaging and movable axially along said interior sealing surface of the screw cap when the cap moves axially on the body portion, (g) said body portion having an internal curved cam track constituting a drive ramp, located in the discharge end portion of its inner annular wall, in the said annular space thereof, and having its uppermost part extending above the external screw threads of the body portion and adjacent to the top wall of the screw cap when the screw cap is screwed down on the body portion, said annular sealing bead surrounding said cam track, (h) said screw cap having a cam follower lug carried by said top wall and extending into the annular space of said body portion and engaging the curved cam track thereof, and having a discharge orifice in its top wall, which is closed by said stopper plug when the cap is screwed down on the body portion under the action of said screw threads, (i) the unscrewing movement of the cap causing it to be forcibly raised axially on the body portion to open the orifice thereof, under the action of the follower lug riding on the curved cam track.

2. The invention as defined in claim 1, wherein:

(a) said support means for the stopper plug comprises a web structure integral with the body portion and the plug, (b) said web structure being disposed below the said annular space.

3. The invention as defined in claim 1, wherein: